US005934147A

United States Patent [19]

Parker

[11] Patent Number: 5,934,147

[45] Date of Patent: Aug. 10, 1999

[54] LINKAGE ARRANGEMENT

[75] Inventor: Clifford Allan Parker, Auckland, New Zealand

[73] Assignee: Telepoint New Zealand Limited, Hamilton, New Zealand

[21] Appl. No.: 08/915,560

[22] Filed: Aug. 21, 1997

Related U.S. Application Data

[63] Continuation-in-part of application No. 08/774,313, Dec. 24, 1996, abandoned, which is a continuation of application No. 08/411,735, Aug. 11, 1995, abandoned.

[30] Foreign Application Priority Data

Oct. 2, 1992 [NZ] New Zealand ..... 244610

[51] Int. Cl.[6] ..... B25J 17/00; B25J 18/00

[52] U.S. Cl. ..... 74/490.05; 74/96; 74/105; 74/490.04; 414/695.5; 901/22; 901/28

[58] Field of Search ..... 74/96, 105, 490.04, 74/490.05; 414/694, 695.5, 686, 687; 901/22, 28

[56] References Cited

U.S. PATENT DOCUMENTS

| | | | |
|---|---|---|---|
| 2,001,803 | 5/1935 | Stephens | 414/917 X |
| 3,027,026 | 3/1962 | Couquet . | |
| 3,313,431 | 4/1967 | Kelly . | |
| 3,867,750 | 2/1975 | Den Bleyker | 414/701 X |
| 4,049,139 | 9/1977 | Stedman | 214/138 |
| 4,389,153 | 6/1983 | Pedersen et al. | 414/687 X |
| 4,403,429 | 9/1983 | Haringer | 37/103 |
| 4,556,360 | 12/1985 | Hoffmann | 414/701 |
| 4,609,322 | 9/1986 | Quant | 414/697 X |
| 4,744,266 | 5/1988 | Shivarov et al. | 74/526 |
| 4,958,981 | 9/1990 | Uchihashi | 414/694 |
| 5,201,235 | 4/1993 | Sutton | 414/917 X |
| 5,456,568 | 10/1995 | Kirby et al. | 91/28 X |

FOREIGN PATENT DOCUMENTS

| | | |
|---|---|---|
| 243547 | 2/1963 | Australia . |
| 14941/83 | 12/1983 | Australia . |

*Primary Examiner*—Allan D. Herrmann
*Attorney, Agent, or Firm*—Jacobson, Price, Holman & Stern, PLLC

[57] ABSTRACT

A linkage arrangement supports an implement such that the implement is movable relative to a support member which is also movable relative to a structure. Movement of the implement and support member is limited by mechanical and/or mechanically operated limits. The linkage mechanism enables an increase in the ability to move and orientate the implement within a limit envelope. In a preferred form, a first linkage arm is pivotably mounted to a prime mover. At a distal end of the first linkage arm an orientation member is pivotably attached, the orientation member pivotably attached to a first limit actuating arm. The rotation of the first linkage arm causes rotation of the orientation member. The orientation member provides a base for the attachment of a further arm or implement. The first arm or implement is prevented from contacting the prime mover by the limits provided by the orientation member.

41 Claims, 5 Drawing Sheets

LINKAGE ARRANGEMENT

RELATED APPLICATIONS

This application is a continuation-in-part of Ser. No. 08/774,313, filed Dec. 24, 1996, now abandoned which is a continuation of Ser. No. 08/411,735, filed Aug. 11, 1995 now abandoned.

FIELD OF THE INVENTION

The present invention relates to the structural arrangements of a linkage arrangement suitable for the manipulative mounting of a tool, implement or object to a structure. In particular the invention relates to a linkage arrangement for mounting implements such as back hoes, verge mowers, shovels and the like to prime movers and will principally be described hereinafter with reference to this application. It should be appreciated, however, that the invention is not limited to this type of use.

BACKGROUND ART

Various arrangements for mounting implements such as back hoes to prime movers are known in the art. For example the arrangements shown in U.S. Pat. Nos. 4,403,429 Harringer, 3,313,431 Kelly, 4,049,139 Stedman, and 3,027,026 Couquet and Australian Patent No. 243,547 Couquet. Such arrangements have been employed in order to improve the flexibility and scope of operation of the implement and have met with varying degrees of success. U.S. Pat. No. 4,403,429 Haringer, discloses an articulated arm for supporting a bucket, mounted on a rotating turret of an excavator and designed for digging parallel to either side of a prime mover. Limits to rotary movement of arms of the articulated arm comprise mechanical stops fixed to the arms. Hence limits to movement and orientation of the bucket is not variable with movement of the arms. Instead, the mobile flexibility of operation through the linkage is mechanically limited even when the implement is in no danger of contacting the prime mover.

U.S. Pat. No. 3,313,431 Kelly discloses a similar double arm linkage arrangement for a back hoe wherein the articulated arm is mounted on a side shift attachment on a prime mover with pivotal movement of the arms about the pivots provided by rack and pinion actuators. The provision of a side shift attachment enables a lateral change in limits at the linkage mounting to the prime mover, however limits to orientated movement of the back hoe relative to the prime mover is fixed, so that there is a similar limitation to flexing and orientation mobility of operation.

U.S. Pat. No. 4,049,139 Stedman discloses a linkage arrangement for a back hoe comprising two linkage arms pivotally connected together, the linkage arrangement being pivotally connected to the prime mover. Pivotal movement between the two arms is provided by a hydraulic swing motors mounted therebetween. The combined hydraulic swing motors give a high degree of flexing mobility such that the linkages can be folded to enable an implement to be stowed close to the prime mover for transport and perform increased manipulative tasks. However, due to this high degree of flexing mobility, skilled operator control of swing motor rotation is required depending on a current position and orientation of the linkage relative to the prime mover to ensure that the implement does not strike the prime mover under normal operating conditions. Operability of the linkage arrangement thus leads to a compromise of operational safety for manipulation.

U.S. Pat. No. 3,027,026 Couquet and Australian Patent No. 243,547 Couquet, disclose a linkage for an excavator such as a trencher having a single arm pivotally mounted on a support frame, and pivotally supporting a digger attachment on a distal end thereof. Pivotal movement of the arm relative to the support frame, and of the digger attachment relative to the arm is by means of manually operated gear actuators whereby the linkage can be set up for a particular operation. An additional actuator is also provided for pivotal movement of the arm relative to the support once the linkage has been set up. Operating flexibility and mobility is similar to Stedman apart from the slow manually actuated controls reducing risk of contacting the support frame. Otherwise, like Steadman, it suffers compromise.

Due to the various compromise situations of the above art which utilise hierarchically controlled actuation and limiting, where each link in a flexible chain of links is both actuated and limited from the orientation of the preceding link, the total of pivot freedom angles equal the orientation change of the last link, and tool, from the support structure. In some cases the hierarchically controlled actuation and limiting is provided from the link before the preceding link by way of parallelogram through the preceding link. In these cases the orientation of the link does not change. Compromise between total freedom values necessary to increase manipulation, and self contact with the machinery is apparent.

Other apparatus such as the linkage arrangement described in U.S. Pat. Nos. 5,201,235 by Sutton and 4,609,322 by Quant disclose single structural link's between the prime mover and the bucket tool. Bucket actuation in the form of hydraulic rams are interconnected between the prime mover, the link and the bucket tool. The interconnection between the prime mover, lift arm and bucket is not a closed assembly as the ram actuation severely effects the geometry and moment values and therefor changes the relative response to the bucket orientation through rotary movement of the lift arm. In the case of such apparatus, this is generally a consequence of providing a linkage arrangement to drive rotation of the implement which, as described for this form of art, seeks to keep the implement's actuated position at a pre-set level to that of the ground during actuated rotation of the main arm. The inter connection of the ram based tool actuation and relative orientation of the tool is suitable for some applications utilising a single link but not for maximising flexibility through freedom angle totals within mechanical limits and without self contact. The bucket actuation being inter linked in such way creates a moment variation of force and top dead centre difficulties as a combined inherent rotation and an actuated rotation concentrate through a single actuating link about a high pivotal value. In both above mentioned forms of art, and many similar, level or orientation only of a tool is anticipated, not mobility in the sense of manipulation requiring flexibility. Had they envisaged such use they would have had a closed assembly by adding the closing orientation base, and actuated from it. They have not purposely established an independent orientation base, at or as, the distal end of the linkage arm. In the prior art devices mentioned either a compromise is made to the freedom of the implement to avoid contact with the prime mover or to safety by increasing the degrees of freedom values. The prior art does not increase the ability to move and vary orientations of an implement about a support structure without striking the support structure with the implement, and arrangement hence are unsuitable to do so.

Other prior art includes such apparatus used in the raising of work platforms such as cherry pickers, some fire engine lifts, etc. These items utilise a closed parallelogram assembly for links between the platform and the vehicle such that each link separately rotates from an orientation base and presents the same orientation at a distal end base as a first end base of each linkage arm assembly and all bases of rotation remain unchanged in its orientation with respect to the structure. All joint bases serve jointly as a distal end base for one arm assembly and as a first end base for another thereby integrating all arm assemblies with a constant orientation relative to the support structure. As each preceding link is rotated with respect to its pivotal connection, the supporting base for the next link is counter-rotated one degree for each degree of rotation of that link, successively. Although such apparatus is highly manipulative and very useful in operation within one half hemisphere off the vehicle, it does not provide a safe working environment for operation about three sides of the structure or vehicle. Such apparatus, when utilised to approach one side of an opposing pair of sides of a vehicle, can be traversed into the vehicle in an attempt to get to the opposite side of the vehicle. By limiting the counter-rotation, the work platform tool or implement can be made to withdraw around the structure as this traverse takes place.

All the above art have, for one reason or another, embraced the hierarchical nature of chain linked movements and compromised with increased link end to link end actuated and limited rotational total values and the resultant possibility of the tool striking the prime mover when working to either side thereof and therefore susceptible to operator error. Alternatively, they have totally countered the orientation side of the heirarchical nature to find a different compromise. Hence with the above prior art devices, there is a limit to the acceptable increase in rotational limits. This limitation on rotational values and limits to avoid striking the prime mover poses an unnecessary restriction on the rotational movement of the tool when positioned for alternate work applications away from the prime mover where there is no danger of striking the prime mover, or access to opposing sides reducing mobility of operation of the device for work operations and for stowing for transportation.

The present invention is thus addressed to methods and apparatus for supporting an implement such that the implement is movable relative to a support member which is also movable relative to a structure, movement of the implement and support member being limited by mechanical and/or mechanically operated limits, such methods and apparatus enabling the integration of multiple links as an integrated chain of links between a support structure and a tool implement or object to increase the ability to move and vary orientation of the implement within a limit envelope, or at least provide the public with a useful choice.

For example in the case of a back hoe, such methods and apparatus may provide a linkage arrangement for the support and positioning of an implement, which enables an increase in the possible scope of operation of the implement mounted thereon compared to conventional support linkages, while still ensuring that the implement does not contact the prime mover when supported close to the prime mover, and which enables the implement to be supported within weight distribution, and dimension requirements for road transportation.

Further aspects and advantages of the present invention will become apparent from the ensuring description which is given by way of example only.

SUMMARY OF THE INVENTION

According to a first aspect of the present invention there is provided a linkage arrangement for mounting an implement to a structure said linkage arrangement comprising:

a first linkage arm assembly having a first end pivotally connected to said support structure and a distal end movable in an arcuate manner as said first linkage arm assembly rotates about said pivotal connection between limits to said rotational movement;

an orientation base arranged about or integral with said distal end of said first linkage arm assembly to inherently counter rotate with respect to rotary movement of said first linkage arm assembly and at least partially in the plane of rotation of said first linkage arm assembly less than one degree for each degree of rotation of said first linkage arm assembly about said support structure;

an implement pivotally mounted directly or indirectly to said distal end of said first linkage arm assembly or said orientation base and arranged to rotate at least partially in the plane of rotation of movement of said first linkage arm assembly; and wherein said pivotal movement of said implement is actuated from said orientation base between mechanical limits such that said implement is limited from contact with said structure and said first linkage arm assembly.

According to a second aspect of the present invention there is provided a method of increasing the ability to move and to change orientation of an implement which is linked to a structure about the structure to avoid by mechanical limitations contact between said implement and said structure comprising the steps of:

providing a first linkage arm assembly mounted to and to rotate with respect to said mounting onto said support structure and mechanically limited from contact therewith;

providing an orientation base pivotally mounted to or integral with a distal end of said first linkage arm assembly such that said orientation base is rotatable at least partially in the plane of rotation of said first linkage arm assembly;

pivotally mounting said implement directly or indirectly to said distal end of linkage arm assembly or said orientation base to rotate with respect to said orientation base at lest partially in the plane of rotation of said first linkage arm assembly;

driving rotation of said first linkage arm assembly about said support structure;

driving rotation of said implement with respect to said orientation base from said orientation base; and inherently counter-rotating said orientation base less than one degree for each degree of rotation of said first linkage arm assembly to relatively counter the arced distance the mechanically limited range envelope of the implement's actuated movement would other wise travel at the distal end of the first linkage arm assembly.

According to a third aspect of the present invention there is provided a method of increasing the ability to move and to change orientation of an implement about a structure comprising the steps of:

providing a first linkage arm assembly pivotally mounted to said support structure and limited from contact therewith;

providing an implement pivotally mounted to said first linkage arm assembly;

providing an orientation means rotating about a distal end of first linkage arm assembly;

actuating rotation of said implement from said orientation means and limiting rotation of said implement with respect to said orientation means; and counter-rotating said orientation means less than one degree for each degree of rotation of said first linkage arm assembly movement.

According to a fourth aspect of the present invention there is provided a method of increasing the ability to move and to change orientation of a tool, implement or object about a structure comprising the steps of:

integrating a chain of successive linkage arm assemblies between said structure and said implement wherein actuated movement of each individual link from its pivotal base inherently partially counters the arced travel and expansion of the envelopes for all links and the tool implement or object connected at the distal end enabling a successive integration of linkage arm assemblies and a tool, implement or object with increased mechanically limited pivotal freedom values within a given or designed total work envelope free from any contacts between any of the support structure, linkage arm assemblies, tool implement or object.

With the above described linkage arrangements and method for increasing the ability to move and to change orientation of an implement and remain mechanically limited from striking the structure. The limits to rotational movement of the implement are adjusted to counter arced travel of its supporting arm inherent with that movement. The rotational limits of the supporting linkage arm and the implement fixed to it are adjusted to counter arced travel of its preceding supporting arm inherent with that movement. Unnecessary restriction to pivotal movement of the linkage arrangement is thus avoided enabling an increase in the ability to move and to change orientation of the implement within a limit envelope, and giving an increase in mobility of operation of the device.

Preferably the structure is a prime mover such as the prime mover of a back hoe or verge mower, but may also be a stationary body.

The implement may be pivotally mounted using a mounted head which may comprise any means whereby a tool or implement may be mounted directly on the linkage arm. In the case of indirect mounting this may involve additional linkage arms fixedly connected to or formed integral with the mounting head. The additional linkage arms may also be provided with mounting heads for directly or indirectly mounting the implement.

The actuating means may comprise any suitable means whereby the linkage arms may be pivoted about its pivotal mounting. For example, this may comprise electrically or hydraulically powered actuators. In the case of hydraulic actuators a hydraulic ram may be connected between the prime mover and the first linkage arm, and another ram or swing motor may be connected between the implement and the orientation base.

The limits may comprise a limit support means on which are mounted mechanical limits, the limit support means being provided on or by the orientation member being pivotally mounted on the linkage arm distal end so as to be movable relative thereto, thereby moving the mechanical limits to rotation. In this case the limit adjusting means may be provided and comprise mechanical means for moving the limit support means relative to the linkage arm with pivotal movement of the linkage arm relative to the structure.

The orientation member may comprise any suitable member that is able to be rotary mounted and may be integral with a part of a linkage arm assembly. In the case where a second or successive linkage arm is rotated by a rotary actuator the orientation member may comprise the housing or shaft of the rotary actuator, with the limits being those for limiting rotation of the shaft relative to the housing. In the case of a vane type rotary actuator with the vane mounted on the shaft, the limits may comprise two limit stops on the housing which abut with opposite sides of the vane.

In the case where the second linkage arm is rotated by a linear actuator having a rod member moving relative to a casing between limit stops provided on the rod member and the casing, the orientation member may comprise a support plate pivotally mounted to the preceding linkage arm distal end with the rod member or casing of the actuator connected between the support plate and the second linkage arm.

In the case where a rotary actuator is used comprising a vane moving in a housing, the cam member may be mounted inside the housing so as to be rotary relative thereto, with the peripheral face of cam members arranged so as to provide adjustments for limits to rotary motion of the vane.

When the limits comprise a limit support means, the limit adjusting means may comprise linkage means connected wither directly or indirectly between the limit support means and the support structure. Any suitable linkage means may be possible providing it enables adjustment of the position of the limit support means and hence the limits, relative to actuated movement of the linkage arm. For example this may comprise any one of or a combination of an hydraulic actuator, gearing, or link arms. In the case of gearing this may comprise gears and a drive shaft extending to the limit support means, whereby rotational movement proportional to pivotal movement of the arm about the first pivot may be transmitted to the limit support means to cause movement thereof.

Alternatively or in addition the linkage means may comprise a limit actuating arm whereby movement proportional to pivotal movement of the linkage arm about the first pivot may be transmitted to the limit support means to cause movement thereof.

A linkage arm assembly may be an assembly of pivotally connected arms that collectively form a first and distal end such that the distal end is an orientation base supported from the support structure. Alternatively or additionally, the linkage arm assembly may provide some provision for linear extension of the distal end from the support structure. In either case, it is the arcuate movement of the distal end about the support structure and the utilisation of that end as an orientation base such that the orientation base integrally rotates upon actuated rotation of the linkage arm assembly that provides a basis for the present invention.

The limit adjusting arms may be either a single arm member per each linkage arm or a pair of arm members per each linkage arm. Alternatively the limit adjusting means may be a linkage arm of a linkage assembly.

Preferably the implement is a back hoe or a verge mower.

BRIEF DESCRIPTION OF THE DRAWINGS

The invention will now be described by way of example only, with reference to the accompanying drawings in which.

BEST MODE FOR CARRYING OUT THE INVENTION

Referring the drawings, it should be noted that the examples displayed are in symmetrical form such that the operations can be seen to be mirror imaged for simplicity of explanation. However, it should be noted that non-symmetrical forms are also envisaged and although reference is made in the following description to terms such as central axle, this relates to those particular embodiments in which a symmetrical form is depicted rather than non-symmetrical forms.

Figure 1:
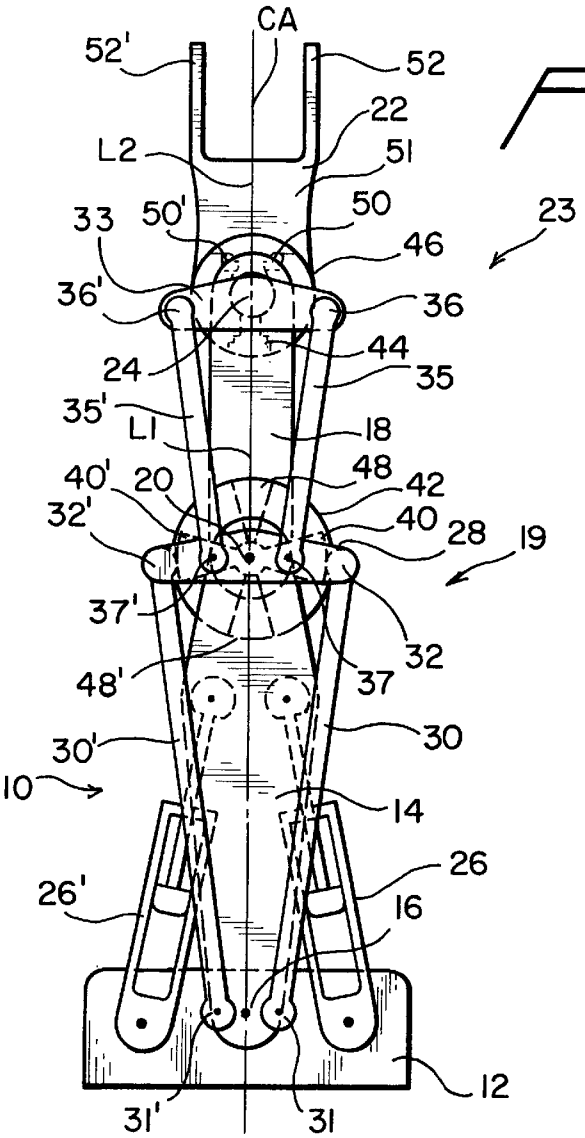
FIG. 1 shows a plan view of a first embodiment of a linkage arrangement according to the invention.

Referring to FIG. 1, a linkage arrangement 10 for mounting on a structure such as a prime mover 12 is shown in the neutral (non-rotated) position. The linkage arrangement assembly 10 includes a first linkage arm 14 pivotally mounted to the structure or prime mover 12 by way of a first pivot 16. The second linkage arm 18 is fixedly attached to the housing of the actuator 19, and the shaft of the actuator is rotary mounted on the first linkage arm 14 at a second pivot point 20. A mounting head in the form of a rotating head 22 is rotary mounted to the second linkage arm 18 by way of a second rotary actuator 23. The rotating head 22 is fixedly attached to the housing of the actuator 23, and the shaft of the actuator 23 is rotary mounted on the second linkage arm 18 at a third pivot point 24.

A pair of hydraulic rams 26, 26' are pivotally mounted to and extend from the prime mover 12 and act on the first linkage arm 14 to cause it to pivot about the first pivot point 16. (This pivotal movement is depicted, for example, in FIGS. 2E and 2F.)

A first limit support member in the form of a first orientation base 28 is fixedly attached to the shaft of the first rotary actuator 19 so as to be rotary mounted to the first linkage arm 14 at the second pivot point 20. The first orientation base 28 is connected to the prime mover by a first limit actuating arm 30, and a first auxiliary arm 30' which extend from respective points 31, 31' on the first orientation base 28, located so that the second pivot point 20 is disposed substantially centrally and symmetrically therebetween.

A second limit support member in the form of a second orientation base 33 is fixedly attached to the shaft of the second rotary actuator 23 so as to be rotary mounted to the second linkage arm 18 at the third pivot point 24. The second orientation base 33 is connected to the first orientation base by a second limit actuating arm 35, and a second auxiliary arm 35' which extend from respective points of pivot 37, 37' on the first orientation base 28 adjacent the second pivot point 20 and to either side thereof, to respective pivot points 36, 36' located so that the third pivot point 24 is disposed substantially centrally and symmetrically therebetween.

The first orientation base 28 is provided with rotational delimiters by way of actuator 19 shaft to vanes 40, 40' defining limits to the extent of rotational motion through rotary contact with actuator vanes 48 48' in rotary chamber of actuator 19 supported form actuator housing 42 that is fixed to second linkage arm 18. The central datum line L1 (FIG. 2) coincides with a central axis CA in the symmetrical configuration of FIG. 1 about which the second arm 18 pivots relative to the first arm 14 as determined by the orientation of orientation base 28.

The second orientation base is provided with rotational delimiters on either side of a vane 44 of the rotary actuator 23 rotating within a chamber 48 of the actuator 23 housing which has a vane protruding from actuator housing 46 with opposing side adjustable cams 50 50' which in turn is fixedly attached to the rotating head 22 (to be described later with reference to FIG. 3). These rotational delimiters provided by vane 44 define limits to the extent of rotational motion of the rotating arm 22 to either side of a central datum line L2 (FIG. 2) (coinciding with a central axis CA in the symmetrical configuration of FIG. 1) about which the rotating head 22 pivots relative to the second arm 18 (as determined by the orientation of orientation base 33).

The rotating head 22 is provided with projecting arms 52, 52' for receiving an implement such as a back hoe, verge mower or the like. In this regard, the boom of the back hoe would be mounted between the arms 52, 52' (as shown in FIG. 6).

Figure 2A:
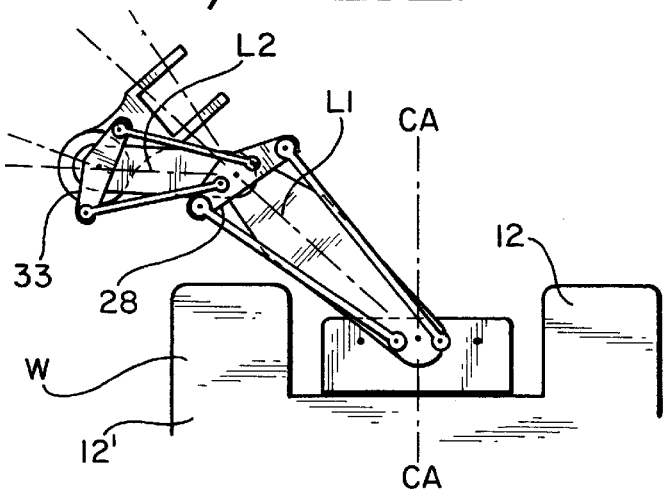
FIGS. 2A, 2B, 2C, 2D, 2E and 2F show various positions of the linkage arrangement of FIG. 1.
Figure 2B:
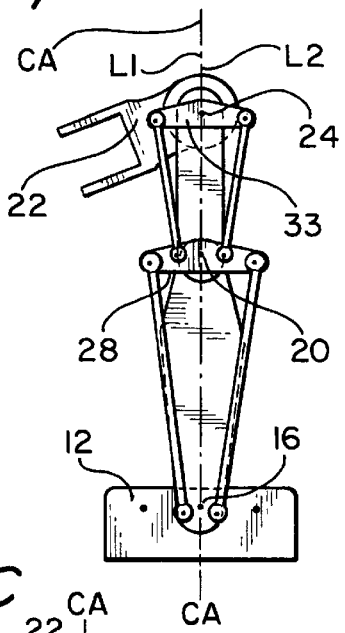
Figure 2D:
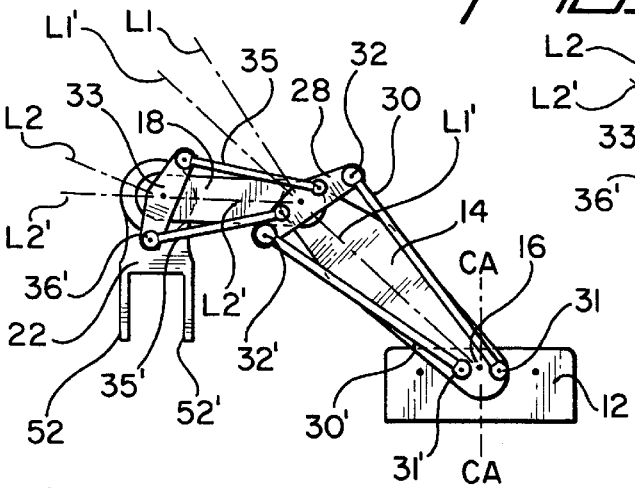

Referring to FIGS. 2A–2F various positions of the linkage arrangement are depicted. In FIGS. 1 and 2B, a central axis extending through the prime mover, first pivot point 16, and the second and third pivot points 20, 24 when the linkage arrangement is in the neutral position, is shown and depicted as CA. It should be noted that the various positions of the linkage arrangement on one side of the central axis CA, can be mirrored (reproduced identically) on the other side of the axis, as shown for example by FIG. 2F which is a mirror of the position shown in FIG. 2D. As a result, a number of advantages are provided (as will later be described) stemming from the linkage arrangement of the present invention.

FIGS. 2A to 2F show views in which the rotating head 22 has been rotated to a position in which slew cam 50' or 50 engages rotational delimiter 44 to stop rotational travel of the rotating head 22. The rotational travel can be effected by operating the hydraulic actuator 23 to turn the actuator housing 46 and vane relative to vane 44 in either clockwise or anti-clockwise directions.

Figure 2C:
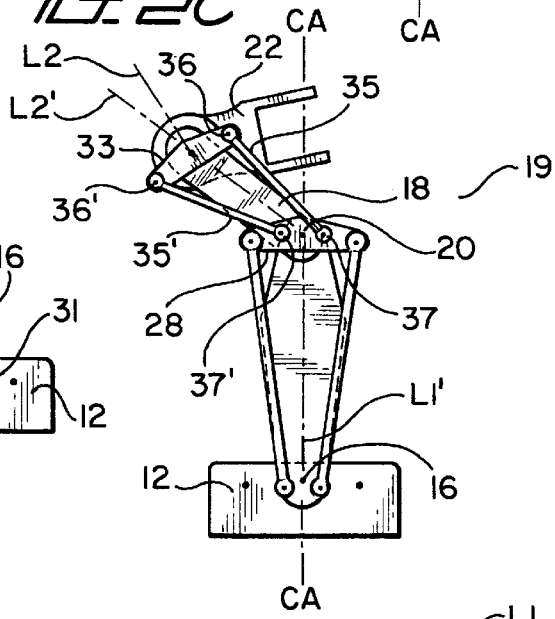

Referring to FIG. 2C, the second arm 18 is shown pivoted about the second pivot point 20. This pivotal movement can be effected by operation of the hydraulic actuator 19 to cause the second arm 18 to rotate until vanes 48, 48' engage rotational delimiters 40', 40 respectively, arresting the movement of the second arm 18.

It will also be noted in FIG. 2C that pivoting of the second arm 18, vanes 40' 40 about orientation base 28 and the second pivot point 20 causes pivotal motion of the second limit actuating arm 35 and second auxiliary arm 35' about their respective points of pivot 37, 37'. As those arms 35, 35' are also pivotally mounted to respective pivot points 36, 36' on the second orientation base 33, the pivotal motion of the second arm 18 about the second pivot point 20 causes a rotary change in orientation between the longitudinal axis of second arm 18 denoted as L2' from the orientation base 33, the actuator vane 44, and the datum line L2 that denotes the midpoint for rotary actuation of the actuator body and tool mounting's rotation about the actuator shaft from orientation base 33 until contact with cams 50 50' limit the movement. The position of vane 44 in actuator 23 shown in dotted lines of FIG. 3 would be the case for FIGS. 2F, 2C and 2A. The unbroken lined vane 44 would represent 2B, 2D, and 2E respectively. Thus, the rotary range of the rotating head 22 with respect to the second arm 18 is changed; (i.e. rotating head 22 has a lesser rotational sweep from axle L2' in the anti-clockwise direction then in the clockwise direction) when the arm 18 is rotated anticlockwise from its support base.

Referring to FIG. 2A a view is shown in which the first linkage arm 14 has been pivoted about the first pivot point 16. This is achieved by extending the piston rod of hydraulic ram 26 and retracting the piston rod of hydraulic ram 26' and extending ram 26 to the respective extents and limits of movement (see FIG. 1). The extent of pivotal motion of the first linkage arm 14 about the first pivot point 16 is limited by the extent of travel of the piston rods within their respective hydraulic rams 26, 26'.

As the first linkage arm 14 is pivoted about the first pivot point 16, the first limit actuating arm 30 and first arm 30' are caused to pivot about their respective pivot points 31, 31'. Since the ends of these arms are pivotally connected at pivot points 32, 32' on the first orientation base 28, pivoting of the first linkage arm 14 about the first pivot point 16 causes a change in orientation of the first orientation base 32, (denoted in FIG. 2E as L1) with respect to the longitudinally axis of the first arm 14 (denoted in FIG. 2E by L1'). L1 is a midpoint datum line of rotary actuation of vanes 48' 48 between vanes 40'60 40. As vanes 40' 40 are fixed through the shaft of actuator 19 to orientation 28 and all are pivotal about the distal end of arm 14 and coincidental pivot 20, then actuation of arm 14 in a clockwise direction pivotally changes, in an anti-clockwise direction, all elements including the limits that are rotary dependent on orientation base 28 and vanes 40' 40".

Figure 2E:
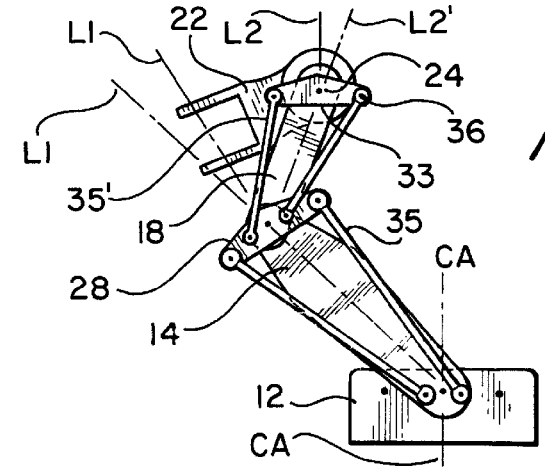
Figure 2F:
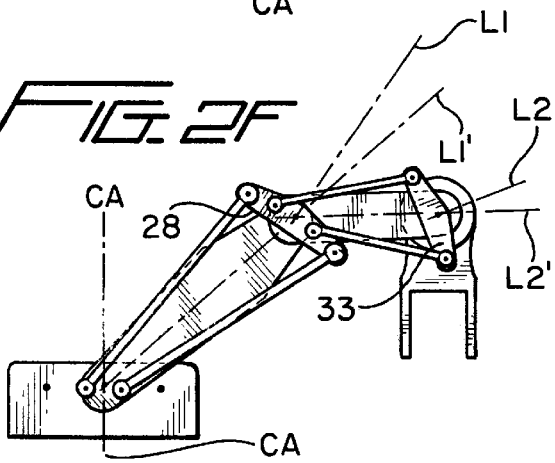

From FIGS. 2E and 2F it can be seen that the new orientation of the first orientation base 28 (and midpoint of arm 18 movement between limits indicated by central datum line L1) with respect to the first arm 14 axis L1' are both toward the CA line that denotes the midpoint of actuated movement of arm 14 from the structure 12. It can also be seen that the actuated movement of arm 18 from the arm 14 position of FIGS. 2A and 2E that the L2 midpoint datum's are toward the L1 midpoint datum of orientation base 28 and from FIG. 2D that the mounting head 22 is at the same angle from L2 in the anti-clockwise direction as it is in FIG. 2A in a clockwise direction. Any actuated movement that rotates an arm in one direction inherently counter rotates the orientation base which limits the actuated position of the outer arm or mounting in the opposite direction to automatically part counter the arc sweep at radius produced by the initial actuation to allow for greater actuation values to be orientated away from sweeping contact with the structure or assembly.

FIGS. 2A and 2C illustrate that, on actuating arm 14 only arm 18 changes in relationship with arm 14 and that arm 18 and mounting 22 remain unmoved relative to each other. For each arm actuated only the orientation base of that arm is inherently rotated through the orientation linking. There are two forms of rotations at each link pivot. These are direct actuation and rotation inherent from actuation of the preceding joint. The rotary value required from any one actuator is therefore less, reducing actuator design difficulties.

By varying the extent of pivotal motion of the first linkage arm 14 about the first pivot point 16 and the second linkage arm 18 about the second pivot point 20, the third pivot point 24 can be located in a variety of positions away from the prime mover 12. Furthermore, by selecting different locations for pivotal attachment of the limit actuating arm 30 to the prime mover 12 and to the orientation base 28, and by changing the location of the delimiters on the orientation base 28 and 33, the linkage arrangement can be designed to suit a variety of applications.

When an implement such as a back hoe is mounted to the rotating head 22, a variety of different sized areas bounded by envelopes which enclose the area of movement and access from which a back hoe may reach out from at the third pivot point 24 are provided.

Figure 4B:
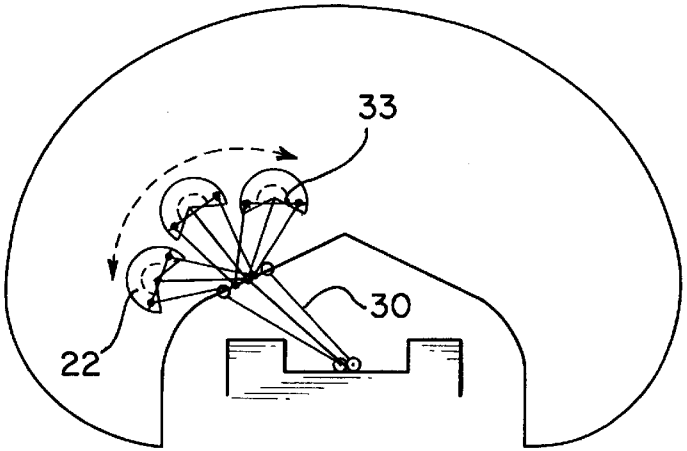
FIGS. 4A and 4B show a schematic plan view of a linkage arrangement accordingly to the present invention, and the possible scope of operation of an implement when mounted on the linkage arrangement.
Figure 4A:
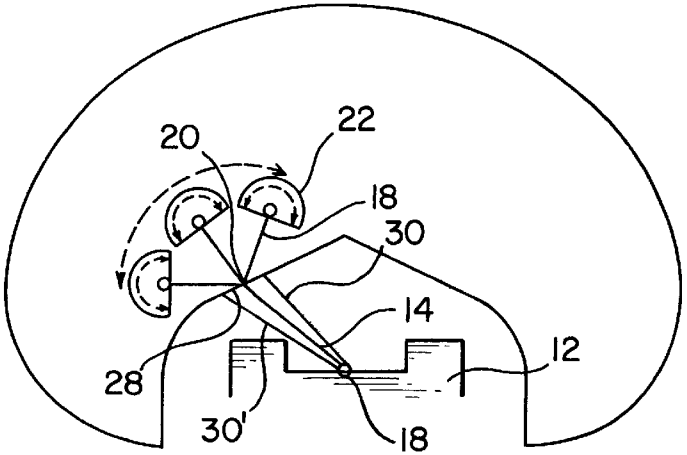

FIG. 4A shows an arrangement with the pivot points for the limit actuating arm 30 and the auxiliary arm 30' positioned relative to the first pivot point 16 so that they do not cross over which does produce a positive ratio and inherently propel an expansion to an operating envelope and reduce the rotary values available before contact with the support structure could be made. The second arm 18 in FIG. 4A is conventionally arranged and the second arm 18 in 4B is a counter actuation assembly. Both 4A and 4B are symmetrical for true mirror visualisation. The outer envelopes of both depict a given length of implement in both FIGS. 4A and 4B drawings the arms 14 and 18 have the same freedom values.

The mounting head freedom values of FIGS. 4B are far greater than 4A due to arm 28 of 4B being an assembly providing counter actuation which can be seen by observing orientation base 33 to the left of 4B represented by the straight line in the mounting head 22 envelope. The limits to rotation relative to orientation base 33 can be seen as the closing radii of the envelope and the anticlockwise radii aligns with the total work envelope that runs parallel to the structure allowing for the width of an implement. Compared with FIG. 4A which has the same required anti clockwise final orientation relative to the structure, the counter rotation value is double added to mounting head 22 adding to the manipulative value of the apparatus. The gain achieved from multiple counter actuation assembly links lies in enhancing the flexing within the linkages without casting the implement for each degree of flex, to create a greater area from which to align an increased radial swinging implement without contacting the support structure.

Referring to FIGS. 2A–2F, take the alignment of arm 14 in FIG. 2F relative to the structure 12 and add to that, arm 18 of FIG. 2E at an orientation relative to that of arm 14, then add mounting head 22 of FIG. 2C relative to arm 18 for a visualisation. Then look at the mounting 22 from 2C fitted at the same arm 18 orientation to FIG. 2E. That would represent a conventional hierarchical linkage arrangement.

Figure 3:
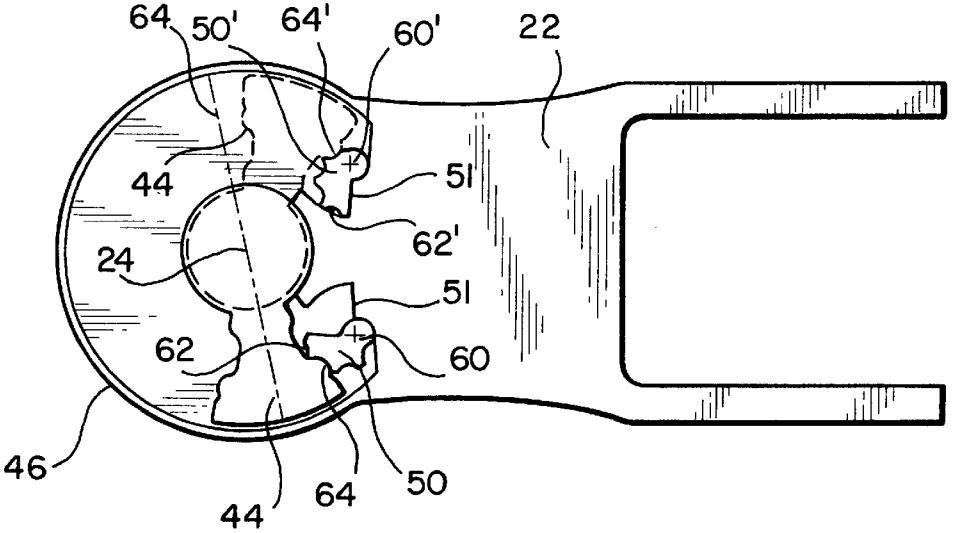
FIG. 3 details a preferred mounting head suitable for use with various embodiments of the present invention.

Referring to FIG. 3, the operation of the rotating head 22 with respect to the second orientation base 33 will now be explained in greater detail. The slew cams 50, 50' are pivotally mounted to the rotating head 22 and vane 50*a* at pivot points 62, 62' respectively which are shaped to engage knobs 64, 64' formed on either side of the rotation delimiter 44 (shown in dotted outline in one position) which is fixedly connected to the second orientation base 33 (not shown in FIG. 3).

In FIG. 3, slew cam 50' is shown in a nominal operating position, i.e. butted up against the casing 51 with slew cam 50 pivoted away from the casing 51, thereby reducing the extent of rotational sweep of the rotating head 22. This configuration may be used for example, when a different implement is mounted on the rotating head.

One of the notches 62, 62' is selected to engage the knob 64, 64' and thus rotational sweep of the rotating head 22 about the second orientation base 33 can be varied to suite the type of implement mounted on the linkage arrangement. When, for example, a back hoe is mounted on the mounting head 22 with the linkage arrangement as shown in FIGS. 1 and 2, the slew cam configuration could be modified to include a number of operating configurations (not shown). These might include a safe, "in-use" configuration wherein the back hoe is restrained from contacting the prime mover, by limiting rotating head 22 rotational sweep, and a transporting configuration (ie. where the rotational sweep is increased by appropriate positioning of the slew cams) which allows the back hoe to be positioned close or on the prime mover for transporting between sites. The various configurations could be modified according to the implement types mounted on the linkage arrangement.

Figure 5:
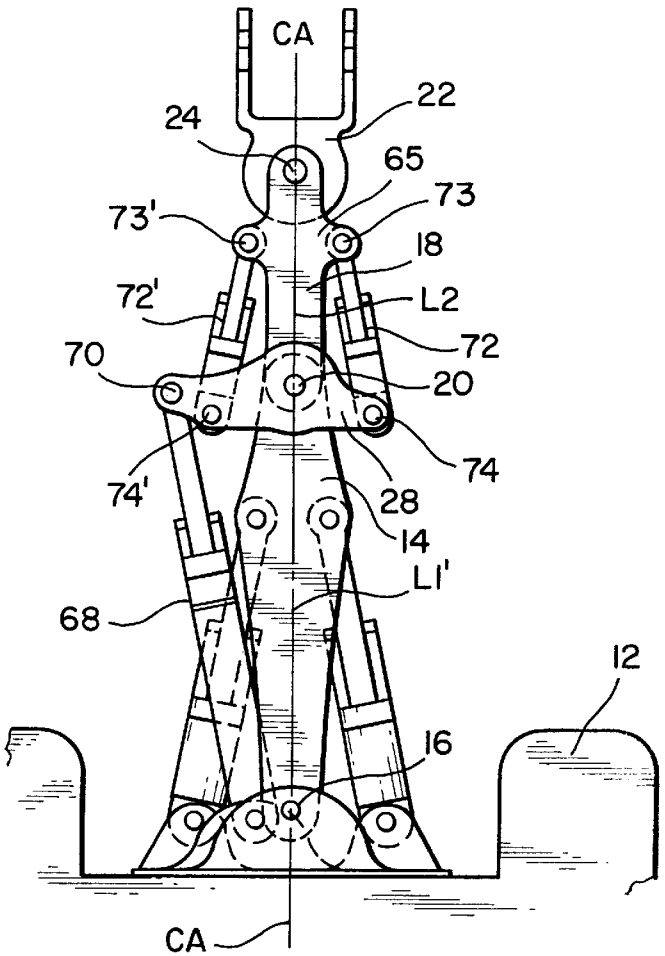
FIG. 5 shows a plan view of a second preferred embodiment of a linkage arrangement according to the present invention.

FIG. 5 shows a second embodiment of the linkage mechanism according to the present invention in which the first limit actuating arms 30 is replaced by a single hydraulic ram 68 pivotally mounted on the prime mover 12 adjacent the first pivot point 16. The piston rod of the hydraulic ram 68 is pivotally connected to the first orientation base 28 at a side point 70. In this case ram 68 could be used as configuration modifier or as an actuator. However rotary values of outer joints would need be severely restricted if used as an actuator in a chain of links as it not only would rotate arm 18 but the orientation base in a hierarchical manner and all would swing with that part of arm 18 movement. FIG. 5 has much less total rotary values than that of FIG. 1 yet more than conventional arrangements. In the embodiment of FIG. 5, the rotary actuator 19 of the embodiment of FIG. 1 is replaced by a pair of respective hydraulic rams 72, 72'. Each ram 72, 72' is pivotally mounted between an attachment member 65 formed integral with the second linkage arm 18, at respective pivot points 73, 73' and to orientation base 28 at pivots 74, 74'. The rams 72, 72' thus provide a similar function to that of the rotary actuator 19, to cause the second linkage arm 18 to pivot about the second pivot point 20 relative to the orientation base 28.

Figure 6B:
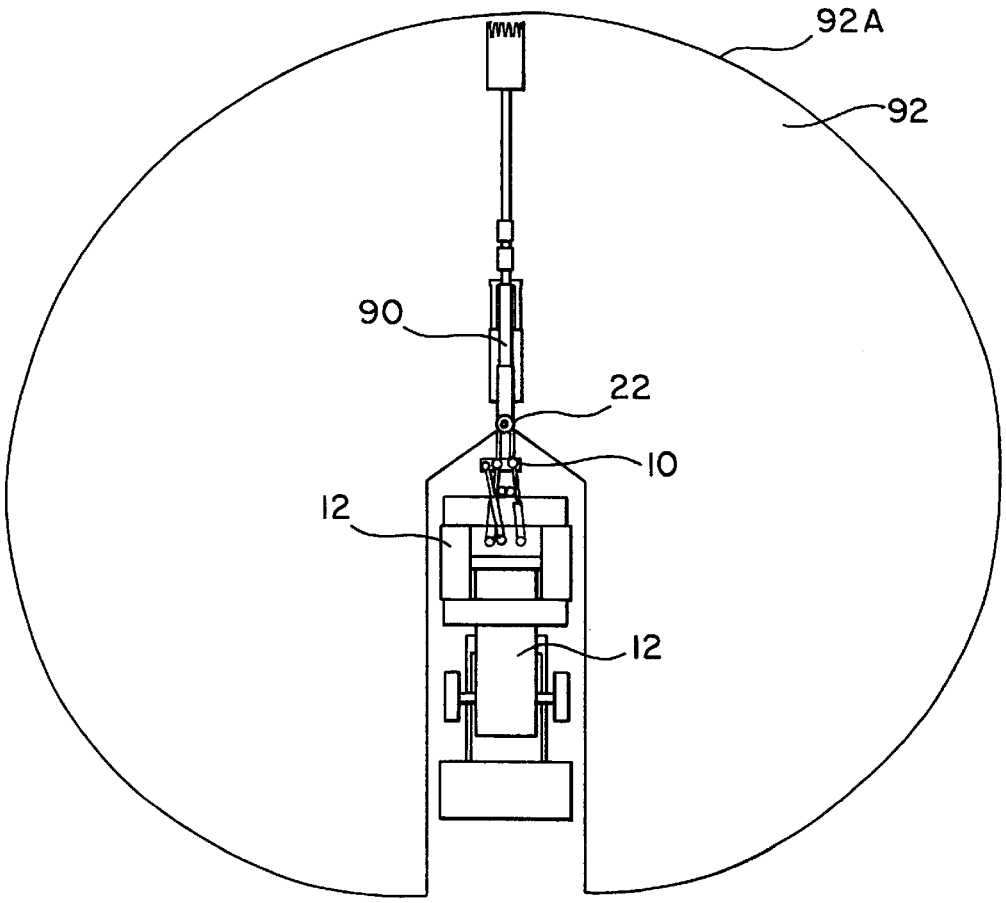
FIGS. 6A and 6B show the linkage arrangement of FIG. 5 mounted to a prime mover, with a back hoe mounted on the mounting head.
Figure 6A:
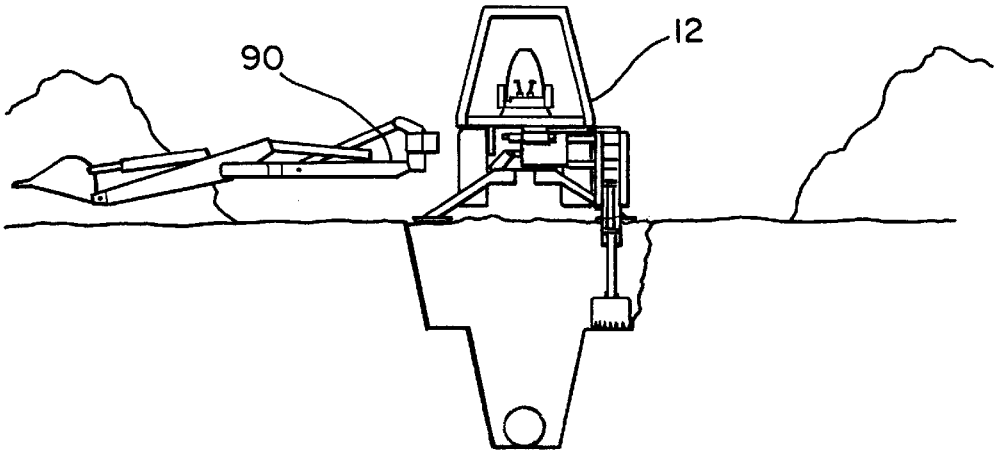

Referring to FIGS. 6A–6B the linkage arrangement of FIG. 5 is shown with a back hoe mounted thereon. The boom 90 of the back hoe is rotary mounted on the rotating head 22 to slew in the vertical plane. FIG. 6A depicts a rear view of the prime mover 12, wherein a back hoe is shown digging adjacent to and laterally of the prime mover 12 and dumping at some distance from the prime mover 12. FIG. 6B shows the extent of digging achievable with the linkage arrangement of the present invention when a back hoe is mounted thereon. This is depicted as area 92 bounded by envelope 92A.

With reference to FIG. 7 a method for locating pivotal connection points for the limit actuating arm on the prime mover 12 to obtain a required pivotal relationship between a linkage arm and an orientation base, such as the pivot point for a limit actuating arm on the first orientation base in the embodiment of FIG. 1.

In this method, with reference to the components of FIG. 1, the first linkage arm 14 is pivotally mounted to the prime mover 12 at the first pivot point 16. The first orientation base 28 is pivotally mounted at the other end of the first linkage arm 14 at the second pivot point 20. The limit actuating arm 30 (a plurality of actuating arms are shown in FIG. 9A, each of which would correspond to various orientations of bases at extremes and a desired in between position) is pivotally mounted to the prime mover 12 and extends to the orientation base 28 to be mounted at reference point 100.

Figures 7A, 7B, 7C:
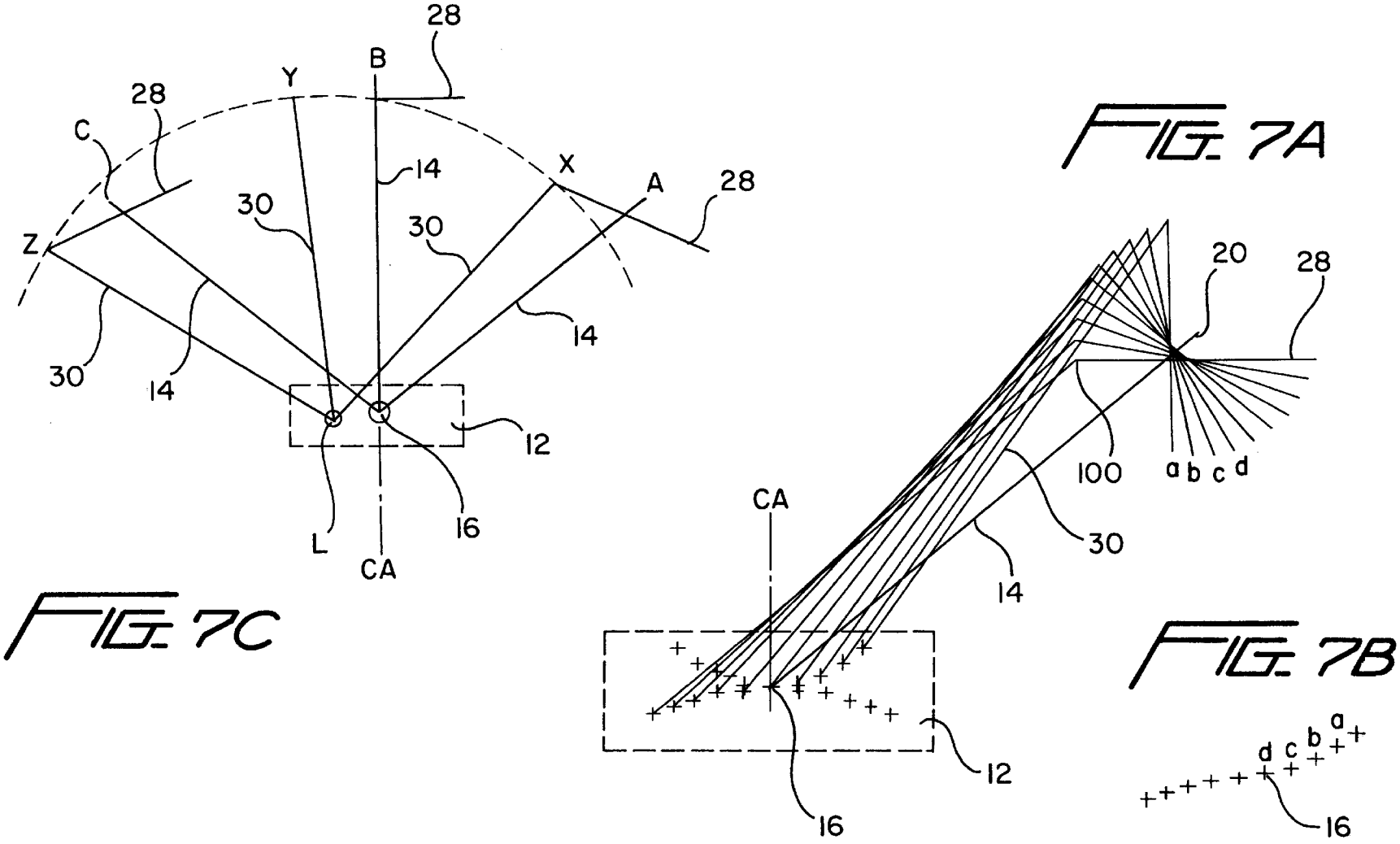
FIGS. 7A, 7B and 7C show schematically, a method by which a point of mounting of a limit actuating arm to a structure can be determined.

The ratio of rotation of the orientation base about the first linkage arm 14, to rotation of the first linkage arm 14 relative to the prime mover 12 is predetermined, and varying ratios are depicted schematically as a, b, c, d, etc in FIG. 7A. For each predetermined ratio a different point of mounting of the limit actuating arm 30 to the prime mover 12 is required. The corresponding points of mounting are shown more clearly in FIG. 7B.

Referring to FIG. 7C, a method for determining the point of mounting of the limit actuating arm 30 to the prime mover will now be explained. It should be appreciated that this method is a preferred method and other similar methods may also be employed and that non symmetrical arrangements may be performed in the same manner using orientation base 28 to one side or other at a different angle and location of X or Z points.

Step A—Linkage arm 14 is pivoted in a clockwise direction about pivot point 16 to position A as shown. A pre selected extent of rotation of the orientation member 28 about the second pivot 20 is determined and shown as reference point 100 taking position x. Position x is recorded.

Step B—Linkage arm 14 is rotated, until it extends perpendicularly from the back of the prime mover 12, to position B corresponding with the central axis CA. When moving to this position, the limit actuating arm 30 rotates about second pivot point 20 until it assumes the positions shown. The position of reference point 100 is recorded (and is shown as y).

Step C—Linkage arm 14 is pivoted about the first pivot point 16 in an anti-clockwise direction until it reaches position C. In the case depicted, the extent of pivotal motion of linkage arm 14 in the anti-clockwise direction from position B to position C corresponds with the extent of pivotal motion in the clockwise direction from position B to position A. When moving to position C, the orientation member 28 rotates about the second pivot point 20 until it assumes the position as shown (a mirror image of the orientation at A is a symmetrical layout). The position of reference point 100 is recorded (and is shown as z).

Step D—Once the positions x, y and z have been established, an arc of a circle is drawn to pass through these three positions. The centre of the circle is determined and its point of correspondence with the prime mover 12 is located. This point becomes the location for mounting of the limit actuating arm 30 to the prime mover 12 and is depicted in FIG. 7C and L.

It should also be noted from FIGS. 7A and 7C that the orientation base 28 is not mounted to the linkage arm 14 at the point at which a straight line extending between its ends crosses (or intersects) linkage arm 14. Instead, the mounting to the linkage arm 14 is off-set to the second pivot point 20. Thus, in the case where a limit actuating arm and an auxiliary arm are mounted to respective ends of the orientation base, the off-set mounting of the orientation base 28 minimises binding at the pivotal connections of the limit actuating arm and the auxiliary arm to the orientation base 28 during pivotal motion of the linkage arm 14 about the first pivot point 16.

With the linkage arrangement of the present invention a number of advantages become apparent, when for example, the linkage arrangement is mounted to a prime mover.

For example, when a back hoe is mounted on the linkage arrangement it is possible to excavate almost entirely around a prime mover, without the need for moving and repositioning the prime mover. At the same time, the prime mover and a human operator of the back hoe are not endangered.

If an elongate trench was to be dug, it is possible to dig the trench with the mounting head rotated to one side of the linkage mechanism and thence to rotate the mounting head through 180 degrees and to continue digging the trench from the other side of the linkage mechanism. This ability is available with a variation of for example 45 degrees in orientation, with 22.5 degrees of freedom to each side, for cleaning off hanging shoulders or for correction after the prime mover had been pulled from its stationary position (unless the work requires the linkage to be position against the limits on one side).

The elliptical arc envelope available to the third pivot due to the change in radius affected by independent operation of the two arms, combined with a possible large degree (of the order of 225 degrees) of rotation of the head, produces a manipulative ability which can accommodate a multitude of alignments and traverses required for such operation as trench digging and the like, which heretofore have not been available for conventional side mounted hoes. Thus, the arrangement makes it possible to extend the length and shape of trenches, holes, excavation pits, etc.

Furthermore, when a verge mower is mounted to the rotating head, the linkage mechanism of the present invention it could be appropriately controlled so that the mower could readily operate to the side and above of both sides of the prime mover, and for example, in the case of hedge trimming, the mechanism movement could be controlled where hedge cuttings of various shapes were desired.

Verge mowers could be mounted to the front and rear of a prime mover, to be operated one or either side of the prime mover when travelling. An operator could be positioned so that the rear-mounted verge mower could be operating forward of the operator in the direction of the prime-mover travel, thereby enabling two sides or passes of, for example, a roadway to be mowed simultaneously. Thus, the operator would have a simultaneous view of the direction of travel, the approaching terrain and implements mounted on the prime mover, and this would facilitate controlled arrangement of implements. The arrangement of the present invention provides the added advantage of operator protection from both sides. Thus, if one or both of the verge mowers was to catch or become entangled during prime-mover travel, the linkage arrangement of the present invention can facilitate an implement breakaway system. In such a system, when an implement, such as a verge mower, becomes entangled, the arrangement breaks away from its forward position about the pivot and swings back parallel to the side of the prime mover to prevent damage to the implement arm, cabin or prime mover generally.

A prime mover could also be fitted with linkage mechanisms according to the present invention at both the front and rear, accommodating for example a back hoe at the rear and shovel at the front of the prime mover.

Whilst the invention has been described with reference to a number of preferred embodiments, it will be appreciated that the invention can be embodied in many other forms that include the structural component of robotics devices.

Aspects of the present invention have been described by way of example only and it should be appreciated that modifications and additions may be made thereto without departing from the scope thereof as defined in the appended claims.

I claim:

1. A linkage arrangement for mounting an implement to a support structure said linkage arrangement comprising:

a first linkage arm assembly having a first end pivotally connected to said support structure and a distal end movable in an arcuate manner as said first linkage arm assembly rotates about said pivotal connection between limits of said rotational movement;

an orientation base arranged about or integral with said distal end of said first linkage arm assembly and arranged to inherently counter rotate with respect to rotary movement of said first linkage arm assembly and at least partially in the plane of rotation of said first linkage arm assembly less than one degree for each degree of rotation of said first linkage arm assembly rotation about said support structure;

said implement pivotally coupled to said distal end of said first linkage arm assembly or said orientation base and arranged to rotate at least partially in the plane of rotation of movement of said first linkage arm assembly; and wherein said pivotal movement of said implement is between mechanical limits from said orientation base such that said implement is limited from contact with said structure and said first linkage arm assembly.

2. A linkage arrangement for mounting an implement to a support structure as claimed in claim 1 wherein said mechanical limit means defines a portion of the border of a work envelope in which said implement can operate.

3. A linkage arrangement for mounting an implement to a support structure as claimed in claim 2 wherein said portion of the border of a work envelope is a border adjacent said structure.

4. A linkage arrangement for mounting an implement to a support structure as claimed in claim 3 wherein said border adjacent said structure is a border extending down two opposed sides of said structure.

5. A linkage arrangement for mounting an implement to a support structure as claimed in claim 1 wherein said mechanical limits comprise limits to the extent of actuation of all actuation means between said support structure and said implement.

6. A linkage arrangement for mounting an implement to a support structure as claimed in claim 1 wherein said indirect mounting of said implement includes a second linkage arm assembly having a first end pivotally mounted with respect to said orientation base and wherein said rotation of said second linkage arm assembly with respect to said first arm assembly is actuated and limited from said orientation base between mechanical limits and a further orientation base is arranged about a distal end of said second linkage arm assembly to counter rotate less than one degree for each degree of rotation of said second linkage arm assembly movement with respect to said first orientation base and said implement is pivotally coupled to said distal end of said second arm of further orientation base and rotation of said implement with respect to said second linkage arm assembly is actuated between mechanical limits from said further orientation base.

7. A linkage arrangement for mounting an implement to a support structure as claimed in claim 1 wherein said indirect mounting of said implement includes at least one pivotal connection to pivot said implement substantially out of plane with the plane of rotation of said first linkage arm.

8. A linkage arrangement for mounting an implement to a support structure as claimed in claim 1 wherein said mechanical limits are adjustable from said orientation base to adjust the extent of limitation of rotation of said implement with respect to said orientation base.

9. A linkage arrangement for mounting an implement to a support structure as claimed in claim 1 wherein said support structure comprises a prime mover.

10. A method of increasing the ability to move and orientate an implement which is linked to a support structure about the support structure to avoid by mechanical limitations contact between said implement and said support structure comprising the steps of:

providing a first linkage arm assembly mounted to and rotary with respect to said mounting onto said support structure and mechanically limited from contact therewith;

providing an orientation base pivotally coupled distal end of said first linkage arm assembly such that said orientation base is rotatable at least partially in the plane of rotation of said first linkage arm assembly;

pivotally mounting said implement directly or indirectly to said distal end of said first linkage arm assembly or said orientation base to rotate with respect to said orientation base at least partially in the plane of rotation of said first linkage arm assembly;

driving rotation of said first linkage arm assembly about said support structure;

driving rotation of said implement with respect to said orientation base from said orientation base; and inherently counter-rotating said orientation base less than one degree for each degree of rotation of said first linkage arm assembly to relatively counter the arced distance the mechanically limited range envelope of the implement's actuated movement would otherwise travel at the distal end of the first linkage arm assembly.

11. A method of increasing the ability to move and orientate an implement about a support structure comprising the steps of:

providing a first linkage arm assembly pivotally mounted to said support structure and limited from contact therewith;

providing an implement pivotally mounted to said distal end of said first linkage arm assembly;

providing an orientation means rotary about said linkage arm assembly;

actuating rotation of said implement from said orientation means and limiting rotation of said implement with respect to said orientation means; and counter-rotating said orientation means less than one degree for each degree of rotation of said first linkage arm assembly.

12. A linkage arrangement for mounting an implement to a support structure, said linkage arrangement including:

a first linkage arm assembly having a first end adapted for mounting by a pivotal connection and a distal end movable in an arcuate manner when said first linkage arm assembly is rotated about said pivotal connection;

first limit means to limit extent of rotational movement of said first linkage arm assembly about said pivotal connection;

an orientation base rotatably coupled to said distal end to be rotatable substantially in the same plane as said pivotal connection;

an implement mounting head pivotally connected to said distal end;

first actuation means for controlling rotational movement of the first linkage arm assembly;

second actuation means for controlling pivotal movement of said implement mounting head;

a linkage means to cause said orientation base to rotate upon rotational movement of said first linkage arm assembly and at least partially in a plane of rotational movement of said first linkage arm assembly, the rotation of said orientation base in the same or a counter direction as the rotational movement of said first linkage arm assembly, but when in the counter direction, the rotation of said orientation base is other than one degree for each degree of rotational movement of said first linkage arm assembly about said pivotal connection, and second limit means to limit the extent of pivotal movement of said implement mounting head, said second limit means being movable commensurate with movement of said orientation base.

13. The linkage arrangement as claimed in claim 12 wherein the pivotal connection is located with a mounting base, said mounting base integral with said support structure.

14. The linkage arrangement as claimed in claim 12 wherein the pivotal connection is located with a mounting base, said mounting base adapted for mounting to said support structure.

15. The linkage arrangement as claimed in claim 12 wherein the mounting head is mounted to said distal end of the first linkage arm assembly such that an implement when mounted by the mounting head can rotate substantially in the plane of rotational movement of said first linkage arm assembly.

16. The linkage arrangement as claimed in claim 15 wherein the mounting head is mounted to said distal end by said orientation base.

17. The linkage arrangement as claimed in claim 16 wherein the mounting head includes pivot mounting means for the pivotal mounting of an implement whereby the implement can rotate at least partially in the plane of rotary movement of said first linkage arm assembly.

18. The linkage arrangement as claimed in claim 12 wherein the linkage means applies a counter direction rotation of said orientation base relative to the direction of movement of the distal end of the first link arm assembly, said counter direction rotation being less than one degree for each degree of rotation of said first link arm assembly.

19. The linkage arrangement as claimed in claim 12 wherein the linkage means applies a rotation of said orientation base in the same direction of rotational movement of the first linkage arm assembly and at a greater rate than that of the first linkage arm assembly.

20. The linkage arrangement as claimed in claim 18 wherein the linkage means comprises at least one link member, which during working operation of the linkage arrangement is of fixed length.

21. The linkage arrangement as claimed in claim 18 wherein the linkage means comprises a linear actuator held in a fixed length during working operation of the linkage arrangement.

22. The linkage arrangement as claimed in claim 19 wherein the linkage means is a pair of fixed length link members, each link member pivotally coupled at one end to said orientation base and at the other end to a pivot point spaced from said orientation base, the distance between the pivot points of the link members different from the distance between the couplings of the link members to the orientation base.

23. The linkage arrangement as claimed in claim 22 wherein the pivot points are on a mounting base.

24. The linkage arrangement as claimed in claim 22 wherein the pivot points are on said support structure.

25. The linkage arrangement as claimed in claim 18 further including a second link arm assembly, a second orientation base rotatably coupled to the distal end of the second link arm assembly and a second linkage means operable in response to movement of said orientation base to thereby form an integrated assembly and pivotal in said plane of rotary movement, said implement mounting head connected to the distal end of the second link arm assembly.

26. The linkage arrangement as claimed in claim 19 further including a second link arm assembly, a second orientation base rotatably coupled to the distal end of the second link arm assembly and a second linkage means operable in response to movement of said second linkage arm assembly from said orientation base to thereby form an integrated assembly and pivotal in said plane of rotary movement, said implement mounting head connected to the distal end of the second link arm assembly.

27. The linkage arrangement as claimed in claim 25 wherein the integrated link assembly includes at least one additional link assembly arm(s), orientation base(s) and linkage means with said implement mounting head connected to the distal end of the at least one additional link arm assembly outermost relative to the first linkage arm assembly.

28. The linkage arrangement as claimed in claim 26 wherein the integrated link assembly includes at least one additional link assembly arm(s), orientation base(s) and linkage means with the implement mounting head connected to the distal end of the at least one additional link arm assembly outermost relative to the first linkage arm assembly.

29. The linkage arrangement as claimed in claim 12 wherein the support structure is a prime mover.

30. The linkage arrangement as claimed in claim 12 in combination with an implement mounted by said implement mounting head.

31. The combination of claim 30 wherein the mounting head is incorporated in said implement.

32. The combination of claim 30 wherein said first limit means defines a portion of the border of a work envelope in which said implement can operate.

33. The combination of claim 32 wherein said portion of the border of the work envelope is a border adjacent said support structure.

34. The combination of claim 33 wherein at least part of said border adjacent said structure is a border surrounding sides including two opposing sides of said structure.

35. The combination of claim 30 wherein the first limit means are adjustable.

36. The combination of claim 30 further including a second link arm assembly, a second orientation base rotatably coupled to the distal end of the second link arm assembly and a second linkage means operable in response to movement of said orientation base to thereby form an integrated assembly and pivotal in said plane of rotary movement, the implement mounting head connected to the distal end of the second link arm assembly.

37. The combination of claim 30 wherein the mounting of said implement includes at least one pivotal connection to pivot, said implement substantially out of the plane of rotary movement.

38. The combination of claim 30 wherein the support structure comprises a prime mover.

39. A method of increasing the ability to move and orientate a tool, implement or object about a support structure comprising the steps of:

integrating a chain of successive linkage arm assemblies between said structure and said implement wherein actuation of each individual linkage arm assembly from its pivotal base inherently partially counters an arced travel and expansion of envelopes for all linkage arm assemblies and the tool, implement or object connected at a distal end of the linkage arm assemblies engaging a successive integration of linkage arm assemblies and a tool, implement or object with increased mechanically limited pivotal freedom values within a given or designed total work envelope free from any contacts between any of the support structure, linkage arm assemblies, tool, implement or object.

40. A method of increasing the ability to move and orientate an implement which is linked to a support structure about the support structure to avoid contact between said implement and said support structure comprising the steps of:

providing a first linkage arm assembly rotatably mounted for movement in a plane of rotation with respect to said support structure and mechanically limited from contact therewith;

providing an orientation base pivotally connected with a distal end of said first linkage arm assembly such that said orientation base is rotatable at least partially in said plane of rotation;

pivotally mounting said implement to said distal end of said linkage arm assembly or said orientation base to rotate with respect to said orientation base at least partially in said plane of rotation;

driving rotation of said first linkage arm assembly about said support structure;

driving rotation of said implement between mechanical limits with respect to said orientation base from said orientation base; and counter-rotating said orientation base less than one degree for each degree of rotation of said first linkage arm assembly to relatively counter the arced distance the mechanically limited range envelope of the implement's actuated movement would otherwise travel at the distal end of the first linkage arm assembly.

41. A method of increasing the ability to move and orientate an implement about a support structure comprising the steps of:

providing a first linkage arm assembly pivotally mounted to said support structure and limited from contact therewith;

providing an implement pivotally mounted to said distal end of said first linkage arm assembly;

providing an orientation means rotatably about said linkage arm assembly;

actuating rotation of said implement from said orientation means and limiting rotation of said implement with respect to said orientation means; and rotating said orientation means in the same direction of rotational movement of the first linkage arm assembly and at a greater rate than that of said first linkage arm assembly.

* * * * *